United States Patent [19]

Olivo

[11] 4,360,119

[45] Nov. 23, 1982

[54] COVER FOR SEALING OPEN MOUTH OF A CONTAINER

[76] Inventor: Amando D. Olivo, Hacienda Totoapan No. 64, Col. Prado Coapa, Mexico 20, D.F., Mexico

[21] Appl. No.: 213,920

[22] Filed: Dec. 8, 1980

[51] Int. Cl.[3] ..... B65D 43/03; B65D 43/04; B65D 51/28

[52] U.S. Cl. ..... 220/23; 206/508; 220/94 A; 220/380; 220/356

[58] Field of Search ..... 220/23, 94 A, 380, 352, 220/356; 206/508

[56] References Cited

U.S. PATENT DOCUMENTS

| | | | |
|---|---|---|---|
| 2,820,683 | 1/1958 | Monaco | 220/94 A |
| 2,913,140 | 11/1959 | Vuillemenot | 220/94 A |
| 3,133,669 | 5/1964 | Scholtz | 220/380 |
| 3,269,588 | 8/1966 | Ruekberg | 206/508 |
| 3,278,074 | 10/1966 | Yamazaki | 220/23 |
| 3,529,744 | 9/1970 | Johnson | 220/94 A |

FOREIGN PATENT DOCUMENTS

| | | | |
|---|---|---|---|
| 934829 | 8/1963 | United Kingdom | 220/23 |

*Primary Examiner*—George E. Lowrance

*Attorney, Agent, or Firm*—Roylance, Abrams, Berdo & Farley

[57] ABSTRACT

A cover for sealing the open mouth of a container has a top member and a cylindrical skirt depending from the top member. The top member has a convex-concave shape to provide an arrangement for retaining substances or devices on the interior surface of the top member for treating the contents of the container. In this manner, the cover may seal the container and treat the container contents.

2 Claims, 4 Drawing Figures

COVER FOR SEALING OPEN MOUTH OF A CONTAINER

BACKGROUND OF THE INVENTION

1. Field of the Invention

This invention relates to a cover for sealing the open mouth of a container. More particularly, the present invention relates to a cover with a top member having a convex-concave shape to provide an arrangement for retaining substances on the interior surface of the top member for treating the contents of the container.

2. Description of the Prior Art

Many products, particularly food products, are stored in sealed containers. The products are hermetically sealed within the containers by a cover. Removal of this cover requires the cover to be cut and renders the cover incapable of resealing the container after a portion of the container contents has been removed. Accordingly, such containers are usually provided with an auxiliary or second cover to seal the open mouth of the container to preserve the remaining container contents.

Conventional auxiliary or second covers simply comprise a flat plate surrounded by a skirt depending perpendicularly from the plate. The covers are formed of an elastic, flexible thermoplastic material. Although these covers fit tightly over the containers, they cannot retain such substances or devices as humidifiers, aromatizers or dryers due to the simplicity of their design. Moreover, conventional covers of this type may be only used with a single size container, may not be readily stacked and often are difficult to apply to and remove from the container.

SUMMARY OF THE INVENTION

Accordingly, it is an object of the present invention to provide a cover for sealing the open mouth of a container which can retain substances on its interior surface for treating contents of the container.

Another object of the present invention is to provide a cover for sealing the open mouth of a container which may be readily stacked and stored.

A further object of the present invention is to provide a cover for sealing the open mouth of a container which is of rugged construction and which is simple and inexpensive to manufacture and use.

The foregoing objects are obtained by a cover for sealing the open mouth of a container having a top member and a cylindrical skirt depending from the top member. The top member has a convex-concave shape to provide an arrangement for retaining substances for treating the contents of the container on an interior surface of the top member.

By forming the cover in this manner, substances and devices such as humidifiers, aromatisizers, dryers may be coupled to the cover on its interior surface to facilitate humidifying, aromatizing or drying of the container contents. The convex-concave shape of the top member of the cover provides adequate space in the cover above the container contents for receiving such devices or substances.

The top member may comprise a peripheral section adjacent the skirt, a concave section in the center of the top member and the concave section between the peripheral and concave sections. A handle and the substance retaining space can be provided by a raised portion which extends diagonally across the concave section and which constitutes a continuation of the curvature of the convex section. This raised portion is coupled to the concave section by parallel vertical walls between which the substance may be retained and which may be gripped to facilitate a manipulation of the cover. These vertical walls can be connected by a pair of parallel vertical reinforcing members which stabilize the vertical walls.

A cylindrical protrusion may extend from the peripheral section which is coaxial with the skirt, extends in an opposite direction from the skirt and has lateral dimensions less than those of the skirt. The skirt and protrusion are coupled by a ledge member, while the protrusion and convex section are connected by a horizontal member. The ledge member and horizontal members are perpendicular to the protrusion and skirt. The combination of the skirt, ledge member and cylindrical protrusion provide a step-shaped profile for the cover to facilitate stacking and nesting of the covers and to make the covers more rigid and sturdy. Since the horizontal member is spaced downwardly from the top edge of the cylindrical protrusion, the cylindrical protrusion may be used to seal containers having a smaller open mouth than of that for the skirt. Thus, the cover of the present invention may be used on two different container sizes.

Handles can extend outwardly from the skirt to facilitate attachment and removal of the cover from the container.

Other objects, advantages and salient features of the present invention will become apparent from the following detailed description which, taken in conjunction with the annexed drawings, discloses a preferred embodiment of the present invention.

BRIEF DESCRIPTION OF THE DRAWINGS

Referring to the drawings which form a part of this original disclosure.

DETAILED DESCRIPTION OF THE PREFERRED EMBODIMENT OF THE INVENTION

Figure 1:
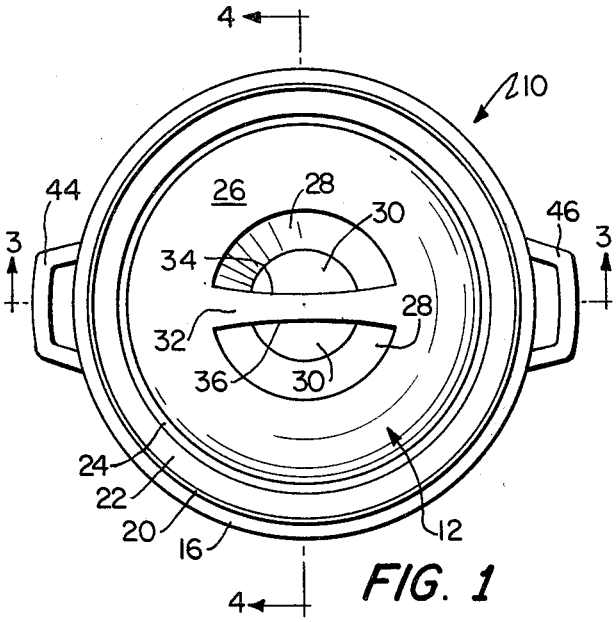
FIG. 1 is a top plan view of a cover according to the present invention.
Figure 2:
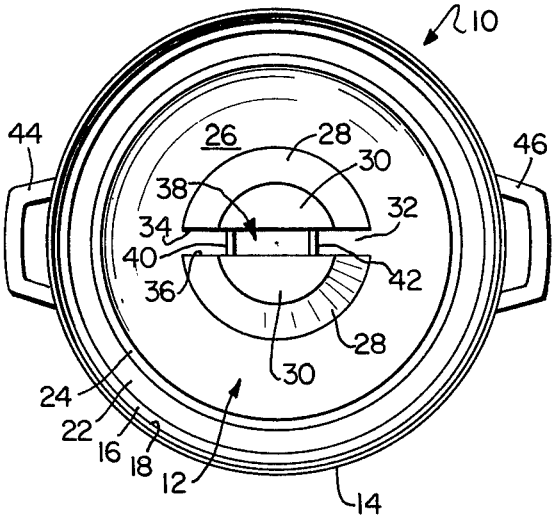
FIG. 2 is a bottom plan view of the cover of FIG. 1.
Figure 3:
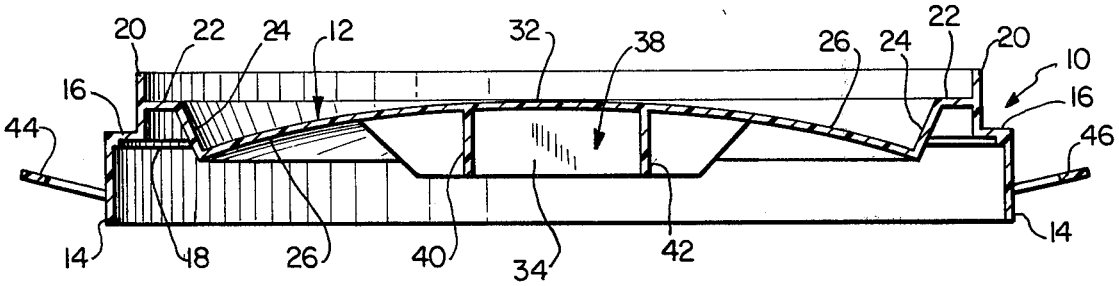
FIG. 3 is an enlarged side view in cross section taken along lines 3—3 of FIG. 1.
Figure 4:
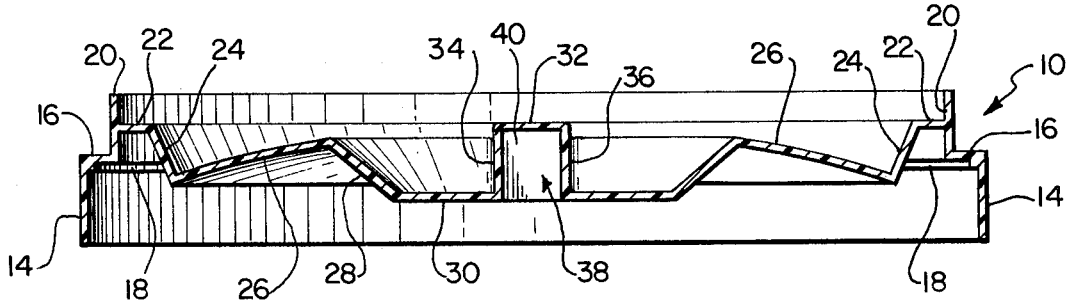
FIG. 4 is an enlarged side view in cross section taken along lines 4—4 of FIG. 1.

Referring to the drawing figures, the cover 10 comprises a top member 12 and a cylindrical skirt 14 formed as unitary article and formed of plastic. Skirt 14 depends from the periphery of top member 12 to frictionally engage the outer surface of a container side wall and seal the open mouth of the container.

An annular ledge member 16 extends perpendicularly inwardly from the top edge of skirt 14. The juncture between ledge member 16 and skirt 14 is reinforced by an annular rib 18 formed on the interior surfaces of ledge member 16 and skirt 14. Ledge member 16 terminates at a cylindrical protrusion 20. Cylindrical protrusion 20 extends perpendicularly from ledge member 16 in a direction opposite to that of skirt 14 and has lateral dimensions less than those of skirt 14. Skirt 14, ledge member 16 and protrusion 20 form a step-shaped outer profile on cover 10 to permit a plurality of covers to be stacked and nested together for efficient and secure storage.

Cylindrical protrusion 20 has an annular horizontal member 22 extending from its inside lateral surface. Horizontal member 22 extends perpendicularly relative to cylindrical protrusion 20 from a location approximately equally spaced from the upper and lower ends of cylindrical protrusion 20. A frustoconical wall 24 extends downwardly and inwardly from the end of horizontal member 22 remote from protrusion 20.

A convex section 26 extends from the end of wall 24 remote from horizontal member 22 in a generally upward and inward direction. Convex section 26 is generally in the form of a hemispherical frustum.

Located in the center of top member 12 is a convex section defined by a frustoconical wall 28 and a horizontal wall 30. Frustoconical wall 28 extends downwardly and inwardly from the end of convex section 26 remote from wall 24 and terminates at horizontal wall 30. Horizontal wall 30 extends across the lower end of wall 28 generally parallel to ledge member 16, horizontal member 22, the top edge of cylindrical protrusion 20 and the bottom edge of skirt 14.

A raised portion 32 extends diametrically across the concave section formed by walls 28, 30 and has a curvature which constitutes a continuation of the curvature of convex section 26. Raised portion 32 is connected to walls 28, 30 by parallel, vertically extending walls 34, 36. Walls 34, 36 are generally in the form of frusto-sectors which taper downwardly. The space 38 defined between parallel vertical walls 34, 36 provides an arrangement with the convex and concave sections of top member 12 for retaining substances for treating contents of the container upon which cover 10 is placed. The exterior surfaces of wall 34, 36 exposed in the concave section of top member 12 provide a grip or handle to facilitate manipulation of the cover.

A pair of spaced apart, generally parallel, vertical reinforcing members 40, 42 couple vertical walls 34, 36. Reinforcing members 40, 42 are generally rectangular in shape and extend perpendicularly relative to walls 34, 36.

By this arrangement, ledge member 16, cylindrical protrusion 20, horizontal member 22 and wall 24 form a peripheral section of top member 12. Walls 28, 30 form a concave section of the top member which is connected to the peripheral section by convex section 26.

Handles 44, 46 extend outwardly from skirt 14 at an angle slightly less than 90° such that the handles extend outwardly and slightly upwardly. The handles are generally U-shaped having a bights located remote from skirt 14 and legs connecting the bights to the exterior surface of skirt 14. The junctures of handles 44, 46 and skirt 14 are located above the bottom edge of skirt 14.

The convex-concave shape of top member 12 forms space 38 in the cover which, together with walls 34, 36, reinforcing members 40, 42 and raised portion 32, provides an arrangement in which suitable substances or devices, e.g., humidifiers, aromatizers and dryers, may be attached on the inside surface of the cover to treat the contents of the container on which the cover is placed. The convex-concave shape of top member 12 also maintains such substances or devices away from the container contents.

The provision of raised member 32 and vertical walls 34, 36 within the concave section on the upper surface of cover 10 provides an additional gripping surface to facilitate manipulation of the cover. Reinforcing members 40, 42 prevent collapse of vertical walls 34, 36 to prevent dislodging of the treating substances or devices.

The arrangement of skirt 14, ledge member 16 and cylindrical protrusion 20 form a stepped outer configuration on cover 10. This stepped outer configuration permits stacked covers to nest within one another to conserve space and provide a stable storage arrangement of the covers. Additionally, this stepped configuration makes the covers more rigid and sturdy so that they will maintain their shape.

The portions of top member 12 located inside of cylindrical protrusion 20 (i.e., section 26, walls 24, 28, 30, 34, 36 and raised portion 32) do not extend above horizontal member 22. Additionally, horizontal wall 22 is spaced downwardly from the upper edge of cylindrical protrusion 20. This leaves the upper portion of the inside lateral surface of cylindrical protrusion 20 unobstructed to enable such inside surface to surround a container. Since cylindrical protrusion 20 has lateral dimensions less than those of cylindrical skirt 14, cylindrical protrusion 20 may be used to seal containers of a smaller size than those on which skirt 14 is used. Thus, cover 10 may be used to seal containers of two different sizes.

Although the invention has been described in considerable detail with particular reference to a certain preferred embodiment thereof, variations and modifications can be effected within the spirit and scope of the invention is defined in the appended claims.

What is claimed is:

1. A cover for sealing an open mouth of a container, which comprises a top member and a cylindrical skirt depending from said top member; said top member having means for retaining substances on an interior surface of said top member for treating contents of the container;

said top member comprising a peripheral section adjacent said skirt, a concave section in the center thereof, a convex section between said peripheral and concave sections, and a raised portion constituting a continuation of said convex section, extending diametrically across said concave section and connected to said concave section by generally parallel vertical walls; said raised portion and said walls defining said means; said walls being coupled by a pair of generally parallel, vertical reinforcing members;

said peripheral section comprising a cylindrical protrusion coaxial with said skirt, extending in a direction opposite to that of said skirt, having lateral dimensions less than those of said skirt and coupled to said protrusion by a ledge member extending perpendicular to said skirt and protrusion to form a stepped outer profile on the cover;

said convex section of said top member being coupled to said protrusion by a horizontal member oriented perpendicular to said protrusion and extending inwardly from a lateral surface of said protrusion at a location spaced from a top edge of said protrusion; said concave and convex sections being located entirely below said top edge of said protrusion and not above said horizontal member.

2. A cover according to claim 1, wherein handles extend outwardly from said skirt.

* * * * *